US008603299B2

(12) United States Patent
Trani et al.

(10) Patent No.: US 8,603,299 B2
(45) Date of Patent: Dec. 10, 2013

(54) METHOD FOR FORMING WEBS OF TRANSVERSELY EXTENSIBLE FIBROUS MATERIAL, IN PARTICULAR PAPER WEBS, AND APPARATUS FOR IMPLEMENTING THE METHOD

(76) Inventors: Giorgio Trani, Venezia (IT); Marion Sterner, Venezia (IT)

( * ) Notice: Subject to any disclaimer, the term of this patent is extended or adjusted under 35 U.S.C. 154(b) by 0 days.

(21) Appl. No.: 13/638,471

(22) PCT Filed: May 31, 2011

(86) PCT No.: PCT/IB2011/001193

§ 371 (c)(1),
(2), (4) Date: Oct. 3, 2012

(87) PCT Pub. No.: WO2011/151705

PCT Pub. Date: Dec. 8, 2011

(65) Prior Publication Data

US 2013/0037231 A1 Feb. 14, 2013

(30) Foreign Application Priority Data

Jun. 1, 2010 (IT) ..... VE2010A0029

(51) Int. Cl.
*D21F 11/14* (2006.01)
*D21F 1/48* (2006.01)
*D21F 3/10* (2006.01)

(52) U.S. Cl.
USPC ..... 162/361; 162/111; 162/197; 162/205; 162/217; 162/271; 162/296; 162/297; 162/358.1; 162/368

(58) Field of Classification Search
USPC ..... 162/111–113, 196, 197, 270, 271, 361, 162/358.1, 296, 297, 358.2, 358.4, 162/900–903, 205, 217, 363, 364, 367, 162/368; 198/847; 428/152–154, 156; 156/183; 264/282, 86, 87; 425/370
See application file for complete search history.

(56) References Cited

U.S. PATENT DOCUMENTS

| | | | | |
|---|---|---|---|---|
| 2,535,734 | A * | 12/1950 | Grettve | 425/370 |
| 6,024,832 | A * | 2/2000 | Trani et al. | 162/13 |
| 6,092,645 | A * | 7/2000 | Wahren | 198/847 |
| 6,488,810 | B1 * | 12/2002 | Halmschlager | 162/109 |
| 2011/0126997 | A1 * | 6/2011 | Trani et al. | 162/202 |

FOREIGN PATENT DOCUMENTS

WO 2010015614 2/2010

* cited by examiner

*Primary Examiner* — Eric Hug
(74) *Attorney, Agent, or Firm* — Themis Law

(57) ABSTRACT

A method for forming a web of transversely extensible fibrous material includes the steps of subjecting a fluid-permeable endless conveyor belt of elastic material, of thickness increasing from its longitudinal axis to its edges, to a localized transverse stretching operation, achieved by temporarily withdrawing a longitudinal band thereof from the surface on which it naturally slides and maintaining it in contact, in this stretched condition, with at least a part of the surface of a support member; depositing a web of pliable fibrous material having a liquid content between 3% and 70% by weight against that portion of the conveyor belt of elastic material which has been transversely stretched; and with vacuum, maintaining the web of pliable fibrous material adhering to the conveyor belt of elastic material during its return to its original configuration, to cause the transverse contraction of the web and the simultaneous partial removal of liquid therefrom.

9 Claims, 6 Drawing Sheets

METHOD FOR FORMING WEBS OF TRANSVERSELY EXTENSIBLE FIBROUS MATERIAL, IN PARTICULAR PAPER WEBS, AND APPARATUS FOR IMPLEMENTING THE METHOD

FIELD OF THE INVENTION

The present invention relates to a method for forming webs of transversely extensible fibrous material, in particular paper webs, and an apparatus for implementing the method.

BACKGROUND OF THE INVENTION

International Patent Application WO20100015614 of 4 Aug. 2009 describes a method for forming webs of transversely extensible fibrous material, in particular paper webs. According to this disclosure, a web of pliable fibrous material having a certain water content is made to adhere to an elastic surface temporarily and locally stretched in a direction perpendicular to the web advancement direction and maintained adhering to said elastic surface at least until this has substantially resumed its original configuration.

SUMMARY OF THE INVENTION

The solution has proved particularly valid and advantageous but may be made even more advantageous by applying the teachings of the present invention, in particular using the following features:

the transverse stretching uniformity of the conveyor belt of elastic material, the adherence of the fibrous material web during transverse compacting, the drying speed, the ease of sliding of the conveyor belt of elastic material relative to the parts with which in comes into contact during transverse stretching and elastic return into the initial configuration, the repeatability of the method when using the same conveyor belt.

The method according to the invention for forming webs of transversely extensible fibrous material, in particular paper webs is characterized by:

subjecting a fluid-permeable endless conveyor belt of elastic material, of thickness increasing from its longitudinal axis to its edges, to at least one localized transverse stretching operation, achieved by temporarily withdrawing at least one longitudinal band thereof from the surface on which it naturally slides and maintaining it in contact, in this stretched condition, with at least a part of the surface of at least one support member, depositing a web of pliable fibrous material having a liquid content between 3% and 70% by weight against that portion of said conveyor belt of elastic material which has been transversely stretched, by the effect of vacuum, maintaining said web of pliable fibrous material adhering to said conveyor belt of elastic material during its return to its original configuration, to cause the transverse contraction of said web and the simultaneous partial removal of liquid therefrom.

BRIEF DESCRIPTION OF THE DRAWINGS

The present invention is further clarified hereinafter by means of some preferred embodiments with reference to the accompanying drawings, in which.

DETAILED DESCRIPTION OF EMBODIMENTS OF THE INVENTION

Figure 1:
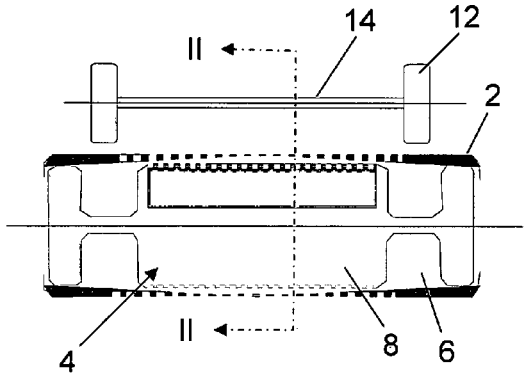
FIG. 1 is a schematic view of an apparatus for implementing the method according to the invention.
Figure 2:
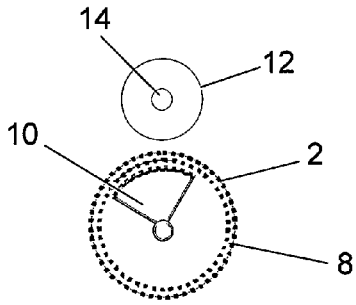
FIG. 2 is a section therethrough on the line II-II of FIG. 1.
Figure 3:
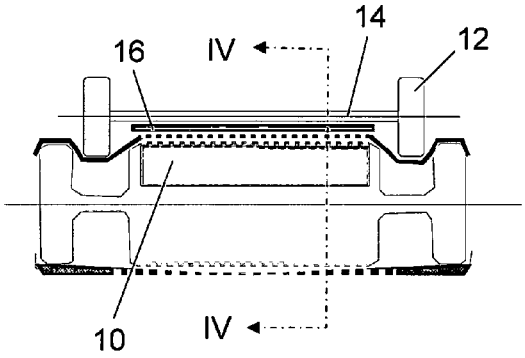
FIG. 3 shows it in the same view as FIG. 1 but in the operative condition.

As can be seen from the figures, in the embodiment illustrated in FIGS. 1-4, the apparatus of the invention comprises an elastic tubular sleeve 2 of perforated or fluid-permeable rubber wrapped about a roller 4 comprising a pair of circumferential grooves 6 provided at equal distances from the two roller ends.

The sleeve 2 can consist of one or more layers of possibly expanded elastomer, or of single or multiple fabric formed of threads which may be elastic or non-elastic, in which case they must be woven in accordance with an elastic weave, or finally of a composite layer formed from the preceding. It can also form the belt of the so-called flat table, which in a traditional paper making machine receives the mix originating from the feed box.

Independently of the manner in which the sleeve is formed, it is of differential thickness in the direction of its transverse extension, for the reasons which will be apparent hereinafter.

The stability of the connection between the sleeve 2 and the roller 4 is assured by folding the sleeve edges about the two roller ends, then securing the folded sleeve edges by any traditional system, which can for example consist of incorporating inextensible cables into the sleeve edges or of retaining those edges of the sleeve 2 adhering to the ends of the roller 4 by backing rollers.

In the embodiment illustrated here, the roller 4, or at least its central portion 8 lying between the two circumferential grooves 6, is hollow and has its cylindrical surface totally perforated. In its interior it houses a fixed suction chamber 10 of circular sector shape extending along the entire axial length of said central portion 8.

The suction chamber 10 can be formed as separate segments in order to modulate the intensity of the suction force.

This suction chamber 10 is connected to a suction pump (not shown in the drawings), and has its cylindrical surface, which faces the perforated surface of the central portion 8 of the roller 4, also perforated or air-permeable. In the case of a perforated surface, the holes can have different diameters in the transverse bands which form said perforated surface, such as to also modulate the intensity of the suction force in this case.

The apparatus also comprises a pair of rollers 12 mounted on a shaft with its axis parallel to the axis of the roller 4, and translatable therewith between a rest position, in which they are positioned external to the circumferential grooves 6 of the roller 4 (see FIGS. 1 and 2) and an operating position, in which they are partially inserted therein, together with the interposed portions of the sleeve 2.

When in operation, i.e. when the apparatus is in the operative stage and the partial entry of the rollers 12 into the grooves 6 has caused transverse stretching of the sleeve 2, a web 16 of pliable material, having a water content between 3% and 70% and consisting for example of the paper mix leaving the flow box of a paper making machine or of a web of finished and rewetted paper, is allowed to fall onto the most stretched portion of the sleeve 2. When this web of pliable fibrous material is rested on the stretched portion of the moving sleeve 2, the vacuum created by the suction chamber 10 causes said web 16 to adhere to said sleeve 2 both in that part in which it has been most stretched and in the next part, i.e. when the rotation of the roller 4 and of the sleeve 2 moves that portion of this latter out of engagement by the rollers 16 to hence enable it to elastically reassume the non-stretched initial configuration. It is evident that the elastic return of the sleeve 2 from its stretched condition to its non-stretched condition, accompanied by the suction effect which maintains the web 16 of pliable material constantly adhering to the sleeve 2, causes transverse contraction of the web and hence renders the final web transversely extensible during its future use, to an extent related to this transverse contraction.

In order to facilitate the adherence of the web 16 to the sleeve 2, this can be advantageously subjected to wetting.

It should be noted that the vacuum exerted by the suction chamber 10 on the web 16 of pliable material, which is undergoing transverse contraction, also results in much water removal from the web, with a considerable reduction in its drying times and consequent advantages both in terms of reduction in the overall length of the drying system (dry end), and in terms of a reduction in the energy consumption related thereto.

Water removal from the web 16 can in any case be further facilitated by subjecting the web to high temperature, preferably differential in the longitudinal direction.

In certain applications, in which a fibrous material web is required which besides being transversely extensible also presents a certain bulk, the suction chamber 10 is faced above the pliable material web 16 by another suction chamber (not shown in the drawings). This must have a power less than that of the chamber 10 in order not to lift the web 16 from the endless belt 2, but sufficient to cause an increase in the web thickness.

In the practical implementation of the apparatus according to the invention and in subsequent experimental tests, it has been noted during transverse stretching of the sleeve 2 that there is a stretching unevenness in the direction of its length, probably caused by the fact that a certain part of the sleeve 2 adheres to the cylindrical surface of the central portion 8 of the roller, whereas the remaining part is in free air. The present invention has eliminated this drawback by making the sleeve 2 of rubber of differential thickness, more specifically of lesser thickness in the part in contact with the portion 8 and of greater thickness in the part in free air.

In this manner the sleeve stretches more in that part in contact with the portion 8, which is thinner, whereas it stretches less in the remaining part, which is thicker, but is not directly involved in the transverse contraction of the web 16 and has to withstand greater stresses by the rollers 12.

Moreover, as it was found that the transverse stretching unevenness of the sleeve 2 is also caused by the fact that during this stage said sleeve is subjected both to tangential sliding along the surface of the central portion 8 of the roller 4, and also creasing at the edges of the circumferential grooves 6 and of the presser rollers 12, the invention uses antifriction means at those parts in which there is contact between said sleeve and the remaining parts of the apparatus.

Figure 5:
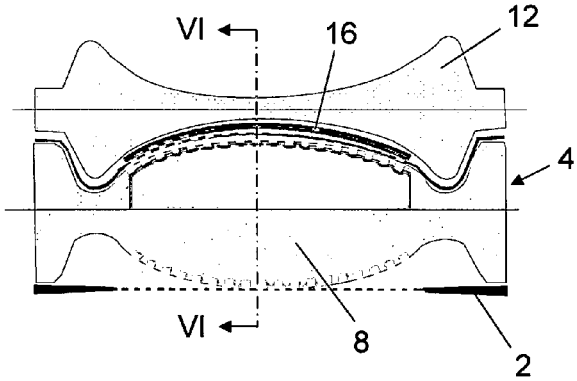
FIG. 5 shows it in the same view as FIG. 3 but as a variant with the support roller for the elastic sleeve having a convex profile.
Figure 6:
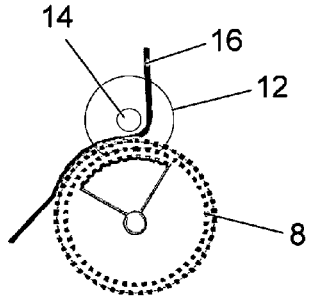
FIG. 6 is a section therethrough on the line VI-VI of FIG. 5.

In FIGS. 5 and 6 the central portion 8 of the roller 4 is formed with a convex profile instead of cylindrical, in this manner it being possible to prevent creasing of the sleeve 2 on the edges of the central portion 8 of the roller 4 during stretching of said sleeve. In this embodiment the two presser rollers 12 are preferably combined into a single roller having a concave profile substantially complementary to that of the convex profiled roller.

Figure 7:
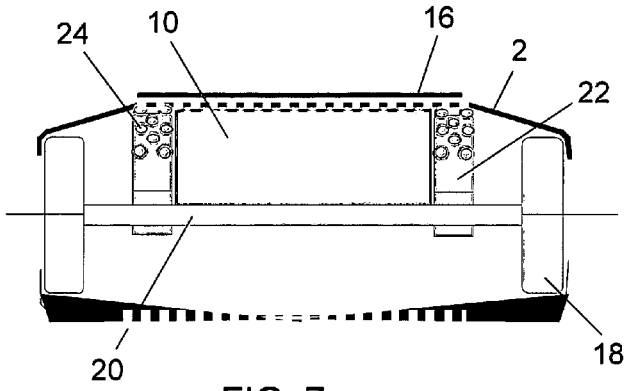
FIG. 7 shows it in the same view as FIG. 3 but as a variant with the sleeve extensible by outward thrust.

FIG. 7 shows an apparatus in which the support roller for the elastic sleeve 2 consists in reality of two end rollers 18, between which the sleeve 2 is taut.

In this case, in that part on which the pliable material web 10 is positioned, the sleeve 2 is stretched not by causing the rollers 18 to approach the rotation shaft 20, but by withdrawing them from said shaft.

This can be advantageously achieved by a pair of fixed roller sectors 22, comprising on their cylindrical surface a plurality of balls 24, which facilitate stretching and the elastic return of the sleeve 2 to its rest condition, once the interference with said roller sectors 22 ceases.

Figure 8:
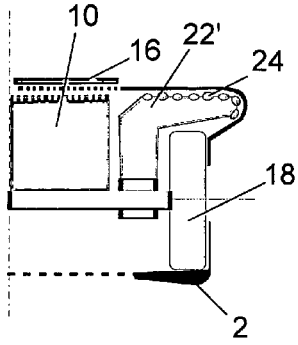
FIG. 8 shows it partially in the same view as FIG. 7 but with the presser elements differently shaped.

In the variant of FIG. 8 fixed presser elements 22' are provided having a form which is different from the fixed roller sectors 22; specifically they extend outwards firstly perpendicular to the rotation shaft 20 for the rollers 18 and then parallel to said shaft beyond the rollers 18. In this manner the sleeve 2 is stretched more greatly in the transverse direction, to offer a larger support surface for the pliable fibrous material web 16.

Figure 9:
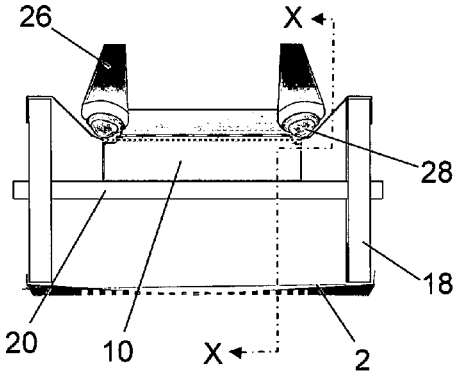
FIG. 9 shows it in the same view as FIG. 3 but as a different variant.
Figure 10:
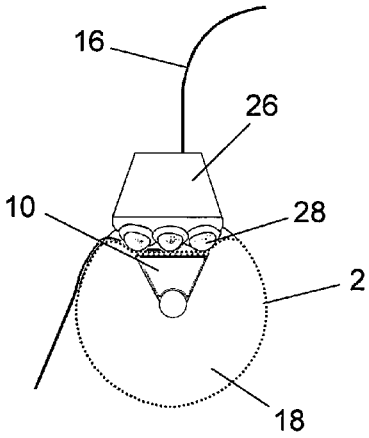
FIG. 10 is a section therethrough on the line X-X of FIG. 9.

FIGS. 9 and 10 show an apparatus in which the sleeve 2 is stretched by approach to the rotation shaft 20 of the rollers 18, achieved by acting on the sleeve with presser elements 26 provided with support balls 28. In particular, by suitably choosing the length of these presser elements 26, the length, measured in the longitudinal direction, of that part of the sleeve 2 which remains in the stretched condition can be defined (see FIG. 10).

Figure 11:
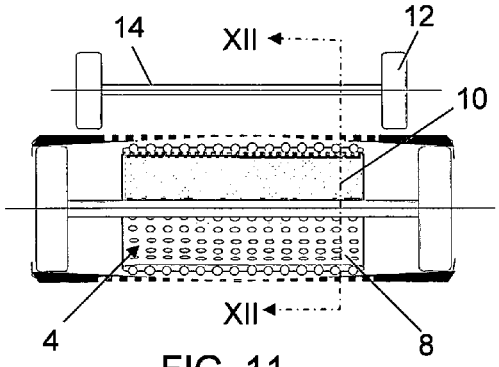
FIG. 11 shows it in the same view as FIG. 1 but as a variant with the support roller for the elastic sleeve consisting of a ball retainer.
Figure 12:
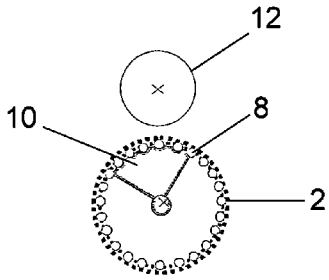
FIG. 12 is a section therethrough on the line XII-XII of FIG. 11.
Figure 13:
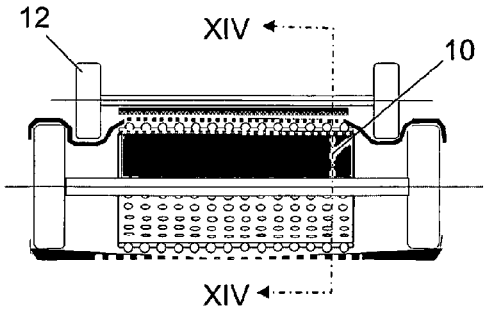
FIG. 13 shows it in the same view as FIG. 11 but in the operative condition.
Figure 14:
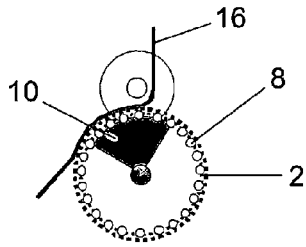
FIG. 14 is a section therethrough on the line XIV-XIV of FIG. 13.
Figure 15:
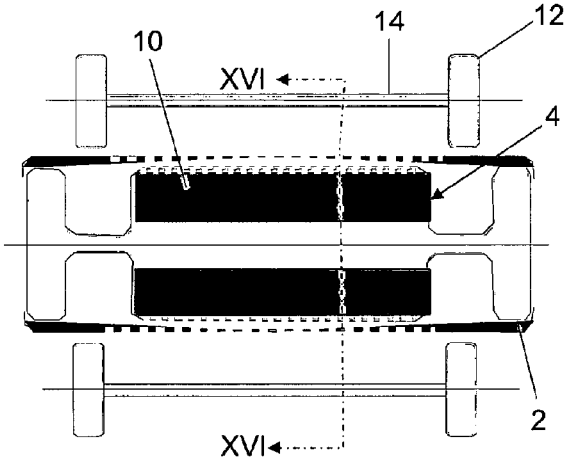
FIG. 15 shows it in the same view as FIG. 1 but as a variant comprising two stretching stations.
Figure 16:
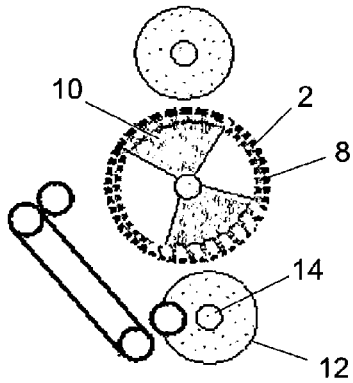
FIG. 16 is a section therethrough on the line XVI-XVI of FIG. 15.
Figure 17:
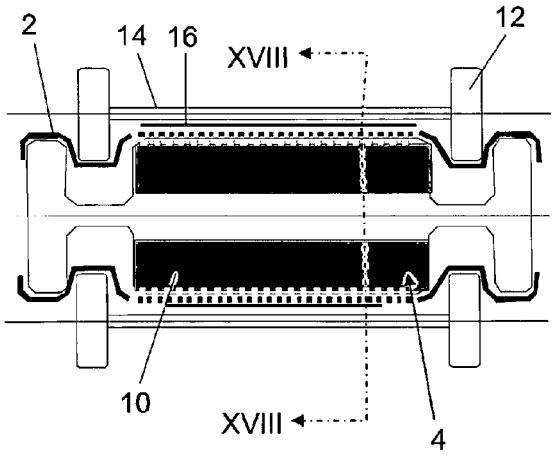
FIG. 17 shows it in the same view as FIG. 15 but in the operative condition.
Figure 18:
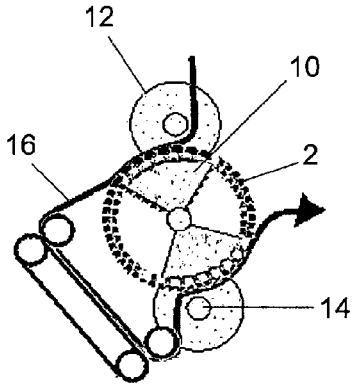
FIG. 18 is a section therethrough on the line XVIII-XVIII of FIG. 17.
Figure 19:
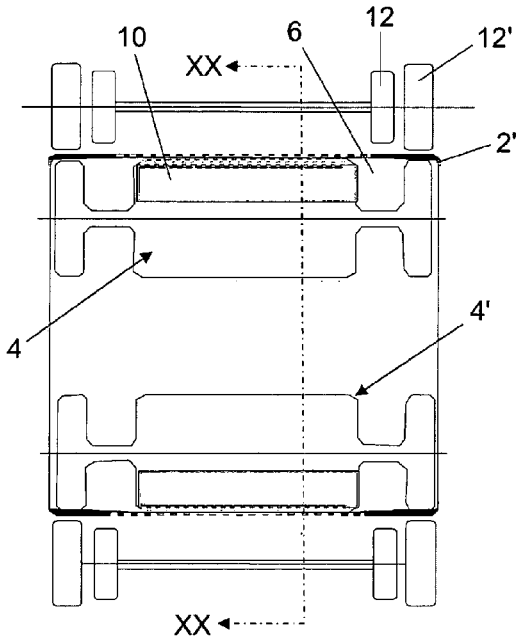
FIG. 19 shows it in the same view as FIG. 1 but as a variant comprising two stretching stations operating on two different rollers wrapped by an extensible elastic belt.
Figure 20:
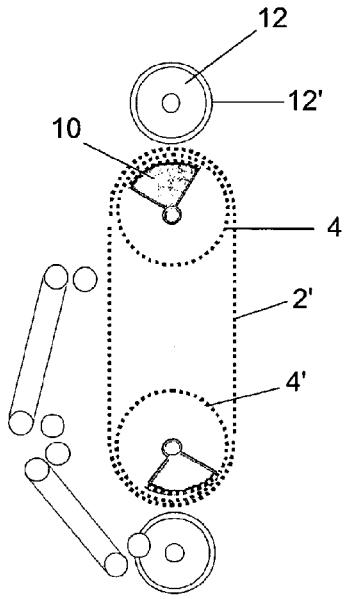
FIG. 20 is a section therethrough on the line XX-XX of FIG. 19.
Figure 21:
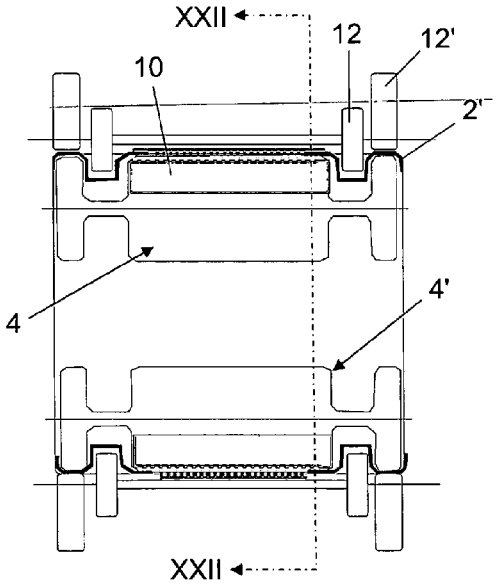
FIG. 21 shows it in the same view as FIG. 19 but in the operative condition.
Figure 22:
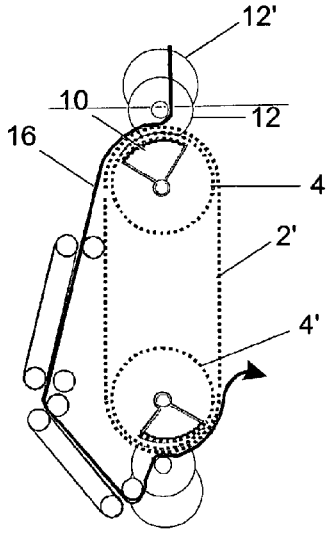
FIG. 22 is a section therethrough on the line XXI1-XXI1 of FIG. 21.

FIGS. 11 and 14 show a roller 4, the central portion 8 of which consists essentially of a ball retainer, which facilitates sliding of the sleeve 2 during stretching. The same result can evidently also be achieved by interposing between the sleeve 2 and roller 4 a film of grease or other lubricant substance.

All the embodiments described up to this point comprise a single stretching section, however according to the invention the pliable material web 16 can be subjected to more than one stretching step.

FIGS. 15-18 show an apparatus with a single roller 4 and a single sleeve 2, but with two separate sleeve stretching stations. The web 16 leaving the first station after undergoing first transverse compaction must evidently be withdrawn from the sleeve 2 before this latter is subjected to second stretching, and be returned to contact with the sleeve only when this has attained its maximum degree of stretch and is able to carry out the second transverse compaction on the web 16.

The same result can also be achieved by a different apparatus configuration, shown in FIGS. 19-22. This embodiment comprises a belt 2' taut between two rollers 4, 4' instead of a tubular sleeve 2 wrapped about a single roller 4. Each roller 4, 4' is provided with its own stretching station for the belt 2'.

Again in this case, as in the previously described case, the pliable material web 16 has evidently to be withdrawn from the belt 2' on leaving the first treatment station, and be again positioned on the same belt after this has been stretched in the second station.

The fibrous material web 16 can also be subjected before or after any compaction step to wetting or to the addition of suitable substances for modifying the belt characteristics. This enables the method to be applied to already formed paper webs.

In all the aforedescribed and illustrated embodiments the transverse compaction of the pliable material web 16 takes place by simple adhesion of said web to the sleeve 2 and to the belt 2', caused by the vacuum effect due to the suction chamber 10 in that part in which the sleeve 2 or belt 2' passes from the stretched condition to the non-stretched condition. However according to the invention, the effect of the adhesion of the web 16 to the sleeve 2 or to the belt 2' can also be accentuated if the web 16 is pressed in that part against the sleeve by an external felt element 30, which also cooperates with the suction chamber 10 to remove water from the web 16 and to flatten the creases under formation. The pressure of the felt element 30 on the web 16 can be adjusted according to requirements.

Figure 4:
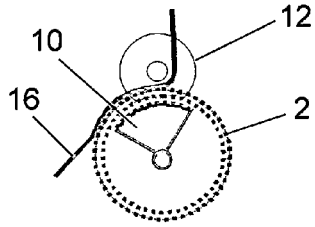
FIG. 4 is a section therethrough on the line IV-IV of FIG. 3.
Figure 23:
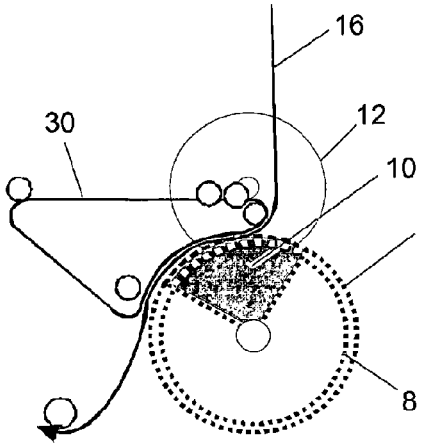
FIG. 23 shows it in the same view as FIG. 4 but as a variant with a felt element which facilitates the transverse contraction stage of the forming paper web.

FIG. 23 corresponds to FIG. 4, but has been integrated with this felt element 30, which remains adhering to the sleeve 2 in that part in which, after undergoing transverse stretching, it is returning to its rest condition. The presence of the felt element 30 ensures better adherence of the web 16 to the sleeve 2 and better water extraction from said web.

The felt element 30 can be advanced either at the same peripheral velocity as the sleeve 2, or at a lower velocity, in order to obtain a final product having greater bulk and provided not only with transverse but also with longitudinal extensibility.

The ability to subject the web 16 to the opposing action of an endless conveyor 2 tending to cause it to advance and which acts on its lower surface, and to a presser element acting on its upper surface and opposing its advancement, does not necessarily require a felt element 20 but instead could also be achieved by one or more rollers which press on said web 16 so that it remains adhering to the surface of the endless conveyor 2.

In particular, the felt element may be replaced by a traditional drying press (shoe press).

In a different embodiment of the invention, the sleeve 2 (or belt 2') instead of consisting of only elastic material consists of elastic sponge material such that the transverse stretching stage also involves its squeezing in the direction of its thickness. In this manner the elastic return of the sleeve 2 to its non-stressed condition also results in a thickness increase and hence an effect of water absorption from the web 16.

Figure 24:
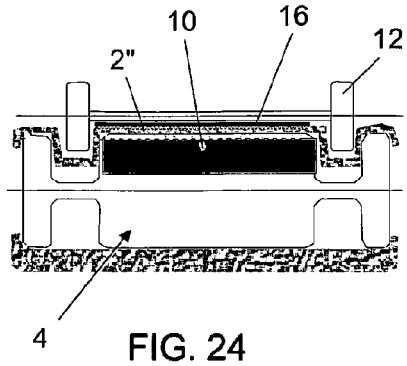
FIG. 24 shows it in the same view as FIG. 3 but as a variant with the sleeve of elastic sponge material.
Figure 25:
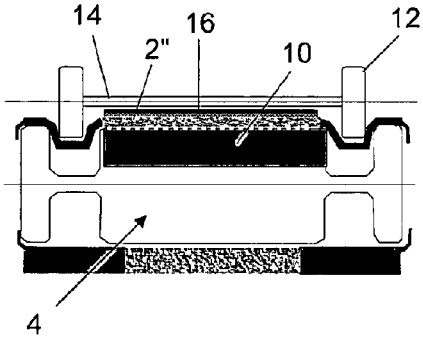
FIG. 25 shows it in the same view as FIG. 24 but as a variant with the sleeve partially of elastic sponge material.

The apparatus shown in FIG. 25 differs from that shown in FIG. 24 in that the sleeve 2' has only its central band formed of sponge material.

Figure 26:
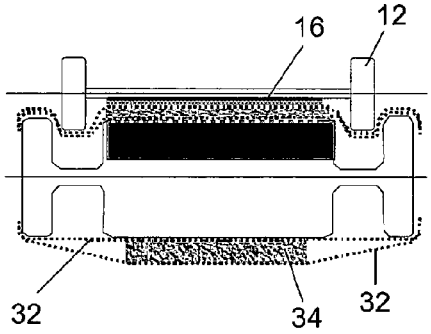
FIG. 26 shows it in the same view as FIG. 24 but as a variant using a sleeve of elastic sponge material interposed between two cloths.

The apparatus illustrated in FIG. 26 shows a sleeve consisting of two cloths or meshes 32 between which an elastic sponge sleeve 34 is interposed. This enables in particular to use cloths or meshes 32 made of non-elastic material, and to instead utilize the intrinsic elasticity of the sponge material.

Figure 27:
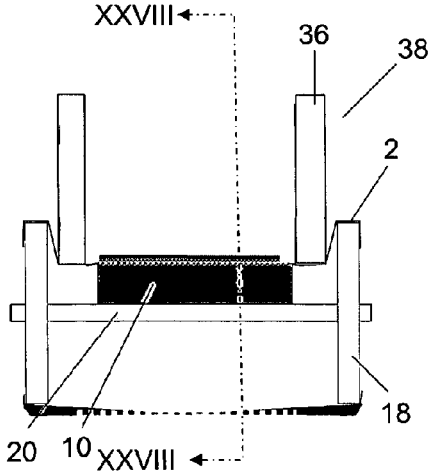
FIG. 27 shows it in the same view as FIG. 3 but as a further variant.
Figure 28:
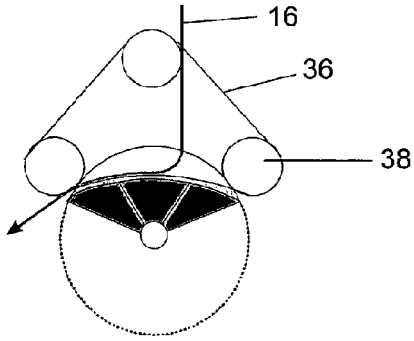
FIG. 28 is a section therethrough on the line XXVIII-XXVIII of FIG. 27.

The apparatus shown in FIGS. 27 and 28 differs from the embodiment shown in FIGS. 9 and 10 in that the presser elements consist of endless belts 36 taut between return rollers 38, arranged such that by suitably shaping the suction chamber 10 the extension of that part of the sleeve 2 subjected to stretching can be modified in the desired manner.

In the drawings the belts 36 are shown as of flat cross-section, however they could evidently be in the form of normal belts of circular cross-section.

Figure 29:
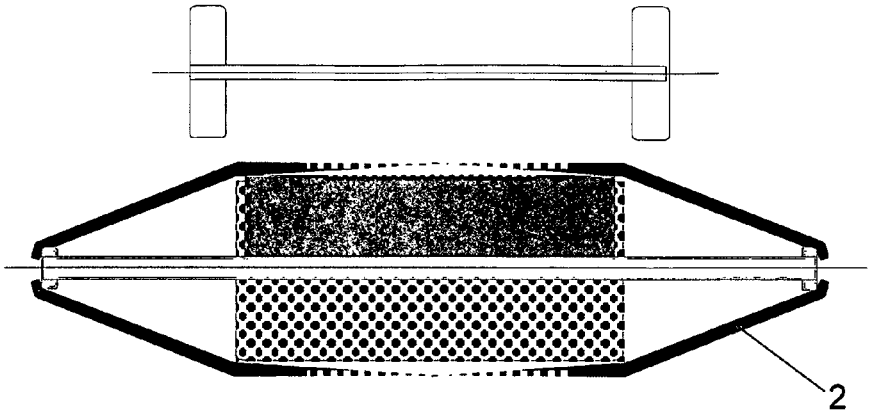
FIG. 29 shows it in the same view as FIG. 1 but as a further variant shown in the non-operative condition.
Figure 30:
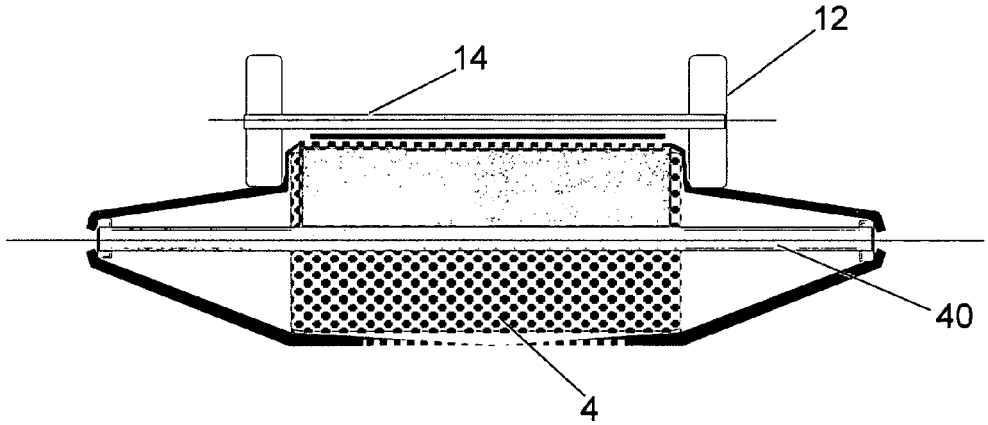
FIG. 30 shows the same variant, but in the operative condition.

The apparatus shown in FIGS. 29 and 30 corresponds substantially to the apparatus already illustrated with reference to previous figures, but instead of the presser rollers 12 stretching the sleeve 2 by inserting bands of this latter into grooves in the roller 4, the presser rollers fold the sleeves externally over the ends of the rollers 4. This embodiment requires a sleeve 2 of greater axial length and, for the roller 4, a support shaft 40 extending for a certain distance beyond the roller end and carrying, fixed to its ends, the ends of the sleeve 2.

In this manner the construction of the roller 4 is more simple and in addition its entire lateral surface can be used as the support surface for the web 16 of pliable fibrous material.

In certain cases a fibrous material web needs to be obtained which besides being extensible in the transverse direction is also extensible in the longitudinal direction.

For this, an apparatus can be used in which the same web 16 can be subjected to two treatments in sequence, the first for achieving transverse compaction of the web 16, and the second for achieving its longitudinal compaction.

Figure 31:
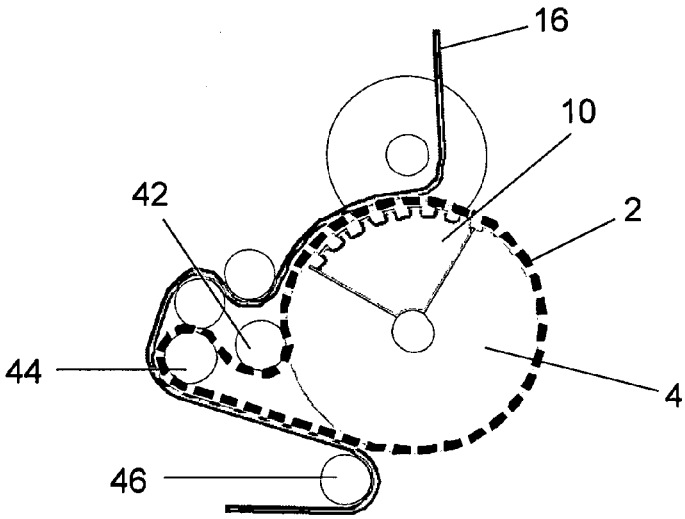
FIG. 31 shows schematically a further variant thereof intended to form a transversely and longitudinally extensible web.

FIG. 31 shows this apparatus schematically. In it the sleeve 2, which besides possessing transverse elasticity also possesses longitudinal elasticity, wraps the roller 4 almost completely except for a small portion in which it is detached therefrom, in a position corresponding with a roller 42, which rotates at a velocity $v_2$ substantially equal to the velocity $v_1$ with which the roller 4 rotates. The sleeve 2 then passes about a roller 44 before returning into contact with the roller 4, at a roller 46.

The rotational velocity $v_3$ of the of the roller 44 is greater than the rotational velocity $v_2$ of the roller 42, whereas the rotational velocity $v_4$ of the of the roller 46 is substantially equal to the rotational velocity $v_2$ of the roller 42 and to the rotational velocity $v_1$ of the roller 4.

In this manner, given the differences in velocity of the various rollers, the sleeve 2 is subjected to longitudinal stretching in the part between the rollers 44 and 46 and to elastic return in the part between the rollers 44 and 46. Hence, when the pliable material web 16 is rested on the sleeve 2 at a point in which it has been stretched transversely, transverse compaction takes place for the aforedescribed reasons. On termination of this treatment the web 16 is then withdrawn from the sleeve 2 before this is subjected to longitudinal stretching.

In a position corresponding with the roller 44, i.e. when the sleeve 2 has been stretched longitudinally, the already transversely compacted web 16 is made to again adhere to the sleeve 2, which along the next part between the rollers 44 and 46 returns to its initial configuration, to cause longitudinal compaction of the web 16.

With the apparatus it is therefore possible to obtain a fibrous material web which is extensible both transversely and longitudinally following double compaction treatment, to which the web 16 is subjected in sequence.

Independently of whether the elastic belt 2 presents one or more parts in which it has been subjected to transverse stretching and possibly also to longitudinal stretching, it can be advantageous for the fibrous material web 16 to be also subjected at any stage of the process, either within the machine or outside the machine, to different treatments with liquid or powder substances or with atmospheric plasmas. In particular a re-wetting treatment can be provided whether by spraying or by passage through a tank, the treatment liquid consisting of water, of a colorant substance or of a waterproofing substance or the like, according to the properties which the paper material to be obtained has to present.

The apparatus which implements the method of the invention can be advantageously combined with traditional creping and compacting machines, for example described in U.S. Pat. No. 2,624,245 and U.S. Pat. No. 6,024,832 for obtaining fibrous material webs which can be stretched longitudinally by utilizing the property of expanding folds, and can also be stretched transversely by utilizing the characteristic of extensibility of the fibrous material in this direction. It can also be advantageously combined with coupling machines to form coupled webs of any type presenting the most suitable characteristics for their various uses.

The invention claimed is:

1. A method for forming a web of transversely extensible fibrous material comprising:

subjecting a fluid-permeable endless conveyor belt of elastic material, said conveyor belt having a thickness increasing from a longitudinal axis thereof to edges thereof, to at least one localized transverse stretching operation, achieved by temporarily withdrawing at least one longitudinal band of said conveyor belt from a surface on which said conveyor belt slides and maintaining said conveyor belt in contact, in this stretched condition, with at least a part of a surface of at least one support member;

depositing a web of pliable fibrous material having a liquid content between 3% and 70% by weight against that portion of said conveyor belt of elastic material which has been transversely stretched;

by effect of vacuum, maintaining said web of pliable fibrous material adhering to said conveyor belt of elastic material during a return thereof to an original configuration thereof, such to cause a transverse contraction of said web and a simultaneous partial removal of liquid therefrom;

using as said conveyor belt a sleeve of said elastic material mounted on a support member consisting of a roller of substantially rigid material, said roller having a lateral surface that is perforated and provided with at least a circumferential groove, said sleeve being fixed at both edges thereof to ends of said roller; and causing a transverse stretching of said sleeve by temporarily moving a circumferential band thereof, which covers said circumferential groove, in a direction parallel to a rotation axis of said roller.

2. The method as claimed in claim 1, wherein there are two circumferential grooves and two circumferential bands of said sleeve, and wherein the step of causing said transverse stretching comprises causing the two circumferential bands of the sleeve to undergo temporary insertion into said two circumferential grooves with a pair of presser rollers having axes parallel to said rotation axis of said roller and disposed in positions corresponding with said two circumferential grooves.

3. The method as claimed in claim 1, further comprising subjecting the endless conveyor belt not only to localized transverse stretching, but also to localized longitudinal stretching, then depositing the web of pliable fibrous material on that conveyor belt section which has already been stretched longitudinally and is undergoing elastic return to an initial configuration of said conveyor belt section.

4. The method as claimed in claim 1, further comprising not only subjecting the web of pliable fibrous material to transverse compaction, but also subjecting the web to impregnation treatment with a substance configured to provide the web obtained therewith with corresponding specific properties.

5. A method for forming a web of transversely extensible fibrous material comprising:

subjecting a fluid-permeable endless conveyor belt of elastic material, said conveyor belt having a thickness increasing from a longitudinal axis thereof to edges thereof, to at least one localized transverse stretching operation, achieved by temporarily withdrawing at least one longitudinal band of said conveyor belt from a surface on which said conveyor belt slides and maintaining said conveyor belt in contact, in this stretched condition, with at least a part of a surface of at least one support member;

depositing a web of pliable fibrous material having a liquid content between 3% and 70% by weight against that portion of said conveyor belt of elastic material which has been transversely stretched;

by effect of vacuum, maintaining said web of pliable fibrous material adhering to said conveyor belt of elastic material during a return thereof to an original configuration thereof, such to cause a transverse contraction of said web and a simultaneous partial removal of liquid therefrom;

using as said endless conveyor belt a sleeve of elastic material mounted on a support roller having an axial length less than an axial length of said sleeve, which is fixed at ends thereof to external prolongations of a rotational shaft of said roller, and causing transverse stretching of said sleeve of elastic material with a pair of presser rollers which have axes parallel to an axis of said support roller and a distance apart greater than the axial length thereof, and are made to translate perpendicular to said axis such as to cause those portions of said sleeve projecting beyond said roller to approach the axis thereof.

6. An apparatus for producing a transversely extensible fibrous material web from a web of pliable fibrous material having a water content between 3% and 70%, comprising:

a fluid-permeable endless conveyor belt of elastic material, of thickness increasing from a longitudinal axis of said endless conveyor belt to edges of said endless conveyor belt;

a first system causing a localized transverse stretching of said endless conveyor belt following withdrawal of at least one longitudinal band thereof from a surface on which it said endless conveyor belt slides, and maintaining said endless conveyor belt adhering, in this stretched condition, to at least a part of a surface of at least one support member;

a second system depositing said web of pliable fibrous material on the transversely stretched portion of said endless conveyor belt; and at least one fixed vacuum source acting through said endless conveyor belt to maintain said web of pliable fibrous material adhering to said endless conveyor belt during an elastic return of said endless conveyor belt to an original configuration thereof, such to cause in this manner a transverse contraction of said web of pliable fibrous material and a simultaneous partial removal of liquid therefrom, wherein the endless conveyor belt consists of a sleeve, the support member consisting of a roller of substantially rigid material having a lateral surface that is perforated and wrapped by said sleeve, and wherein said roller is provided with at least one circumferential groove to be covered by said sleeve after fixing said sleeve at both ends thereof to ends of said roller.

7. The apparatus as claimed in claim 6, further comprising a presser roller having an axis parallel to an axis of said roller and acting to cause temporary localized insertion of said sleeve into said circumferential groove.

8. The apparatus as claimed in claim 6, wherein said endless conveyor belt consists of said sleeve wrapped about a roller of substantially rigid material having a lateral surface perforated and provided with a pair of circumferential grooves, said sleeve being fixed at both edges thereof to ends of said roller, further comprising a pair of presser rollers mounted on a shaft translatable perpendicular to an axis of said shaft to insert said presser rollers into said circumferential grooves, thereby dragging those portions of said sleeve covering said grooves into said circumferential grooves.

9. The apparatus as claimed in claim 6, further comprising a first system causing localized longitudinal stretching in the endless conveyor belt and a second system depositing said web of pliable fibrous material on that endless conveyor belt section which has already been stretched longitudinally and is undergoing elastic return to an initial configuration thereof.

* * * * *